US009901178B2

(12) United States Patent
Selig

(10) Patent No.: US 9,901,178 B2
(45) Date of Patent: Feb. 27, 2018

(54) METHOD FOR MAKING SEATING FROM PRESSURE VESSELS

(71) Applicant: Colin Selig, Lafayette, CA (US)

(72) Inventor: Colin Selig, Lafayette, CA (US)

( * ) Notice: Subject to any disclaimer, the term of this patent is extended or adjusted under 35 U.S.C. 154(b) by 476 days.

(21) Appl. No.: 14/524,868

(22) Filed: Oct. 27, 2014

(65) Prior Publication Data

US 2015/0115686 A1 Apr. 30, 2015

Related U.S. Application Data

(60) Provisional application No. 61/898,434, filed on Oct. 31, 2013.

(51) Int. Cl.
*A47C 5/04* (2006.01)

(52) U.S. Cl.
CPC ..... *A47C 5/046* (2013.01); *Y10T 29/49895* (2015.01); *Y10T 29/53961* (2015.01)

(58) Field of Classification Search
CPC ..... A47C 5/046
See application file for complete search history.

(56) References Cited

U.S. PATENT DOCUMENTS

D683,146 S 5/2013 Selig
D683,147 S 5/2013 Selig
D683,148 S 5/2013 Selig
D716,572 S 11/2014 Selig
D721,237 S 1/2015 Selig
2007/0000111 A1* 1/2007 Johnson ..... A47C 7/282 29/91.1
2014/0026389 A1* 1/2014 Green ..... B25H 1/10 29/446

OTHER PUBLICATIONS

Drum Works Furniture Website printout www.drumworksfurniture.com.*

Selig, Colin. "Genesis: Creation of Propane Tank Seating," version of Oct. 15, 2013. Internet. Available at http://www.colinselig.com/genesis.html. Via Internet Archive: http://web.archive.org/web/20131015190723/http://www.colinselig.com/genesis.html.

Selig, Colin. "Home: Colin Selig Seating Sculptures from Propane Tanks," version of Sep. 9, 2013. Internet. Available at http://www.colinselig.com/home.html. Via Internet Archive: http://web.archive.org/web/20130909045914/http://www.colinselig.com/home.html.

* cited by examiner

*Primary Examiner* — Moshe Wilensky
(74) *Attorney, Agent, or Firm* — Andrew McAleavey; PatentBest

(57) ABSTRACT

Disclosed are seating made from pressure vessels, such as cylindrical propane tanks with hemispherical ends, as well as methods for making this kind of seating. The methods involve cutting sections of the reclaimed tanks and placing those sections on a jig that establishes defined, ergonomic positions for seat and back portions of the furniture, and welding appropriate ends or supports to the sections to form the piece of furniture. The pieces of furniture are made without bending, rolling, or otherwise changing the shape of the cut sections from the pressure vessel.

15 Claims, 7 Drawing Sheets

METHOD FOR MAKING SEATING FROM PRESSURE VESSELS

CROSS-REFERENCE TO RELATED APPLICATIONS

This application claims priority to U.S. Provisional Patent Application No. 61/898,434, filed Oct. 31, 2013, the contents of which are incorporated by reference in their entirety. This application is also related to U.S. Design patent application Ser. No. 29/469,817, filed Oct. 15, 2013, and U.S. Design patent application Ser. No. 29/459,108, filed Jun. 26, 2013, the contents of both of which are incorporated by reference in their entirety.

BACKGROUND OF THE INVENTION

1. Field of the Invention

In general, the invention relates to methods for making seating from pressure vessels, such as propane tanks, and to seating made with such pressure vessels.

2. Description of Related Art

The present inventor, Colin Selig, has made metal seating from discarded propane tanks. Designed to store gas under high pressure, these tanks are typically made of ¼ inch or thicker plate steel, and have a generally cylindrical body with welded hemispherical ends.

In the existing Selig manufacturing process, the metal from these discarded tanks is carefully dissected, and the curved and hemispherical parts are reassembled into a seat without any additional forming or shaping of the metal. In a typical process, a discarded propane tank with a volume of about 250 U.S. gallons and a diameter of about 30 inches is used as the starting material.

Existing Selig propane tank furniture designs include those disclosed and claimed in U.S. Design Pat. Nos. D683,146, D683,147, and D683,148, the contents of all of which are incorporated by reference in their entireties. The pieces of furniture disclosed in these patents have been manufactured by hand using ad hoc processes to cut and join the cut sections of propane tank. These manufacturing processes were experimental, inaccurate and made it difficult to make pieces of furniture with consistent shapes, proportions, and other characteristics.

SUMMARY OF THE INVENTION

Aspects of the invention relate to methods for repeatably producing comfortable pieces of seating using continuously curved sections of discarded pressure vessels without bending, rolling or otherwise changing the curvature of the source material. The discarded pressure vessels, in most embodiments, will be generally cylindrical tanks with welded hemispherical ends, such as propane tanks. These methods include the use of templates when cutting sections from the discarded pressure vessels by hand and a custom jig that establishes the correct spacing and relationship between seating elements and backrest elements.

The methods may include clamping cut sections of recycled material to the jig in defined positions to serve as seat and back portions of the pieces of furniture and welding, or otherwise securing, support members to or between the seat and back portions.

A second aspect of the invention relates to the manufacture and use of seating that combines a curved seat with a curved backrest. This arrangement may provide superior ergonomics.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the invention, and in which.

DETAILED DESCRIPTION

Embodiments of the invention relate to methods of repeatably producing comfortable seating, and to seating produced by these methods. Generally speaking, this type of seating is made with continuously curved parts cut from discarded pressure vessels, such as discarded propane tanks. In addition to being continuously curved, these kinds of pressure vessels usually have discrete sections—e.g., a central cylindrical section and two hemispherical endcaps—each of which has a consistent radius or degree of curvature. While the source material in these methods is cut and ground to make the final pieces, the original curvature is retained; the source material not bent, rolled, or otherwise reshaped during manufacture.

Figure 1:
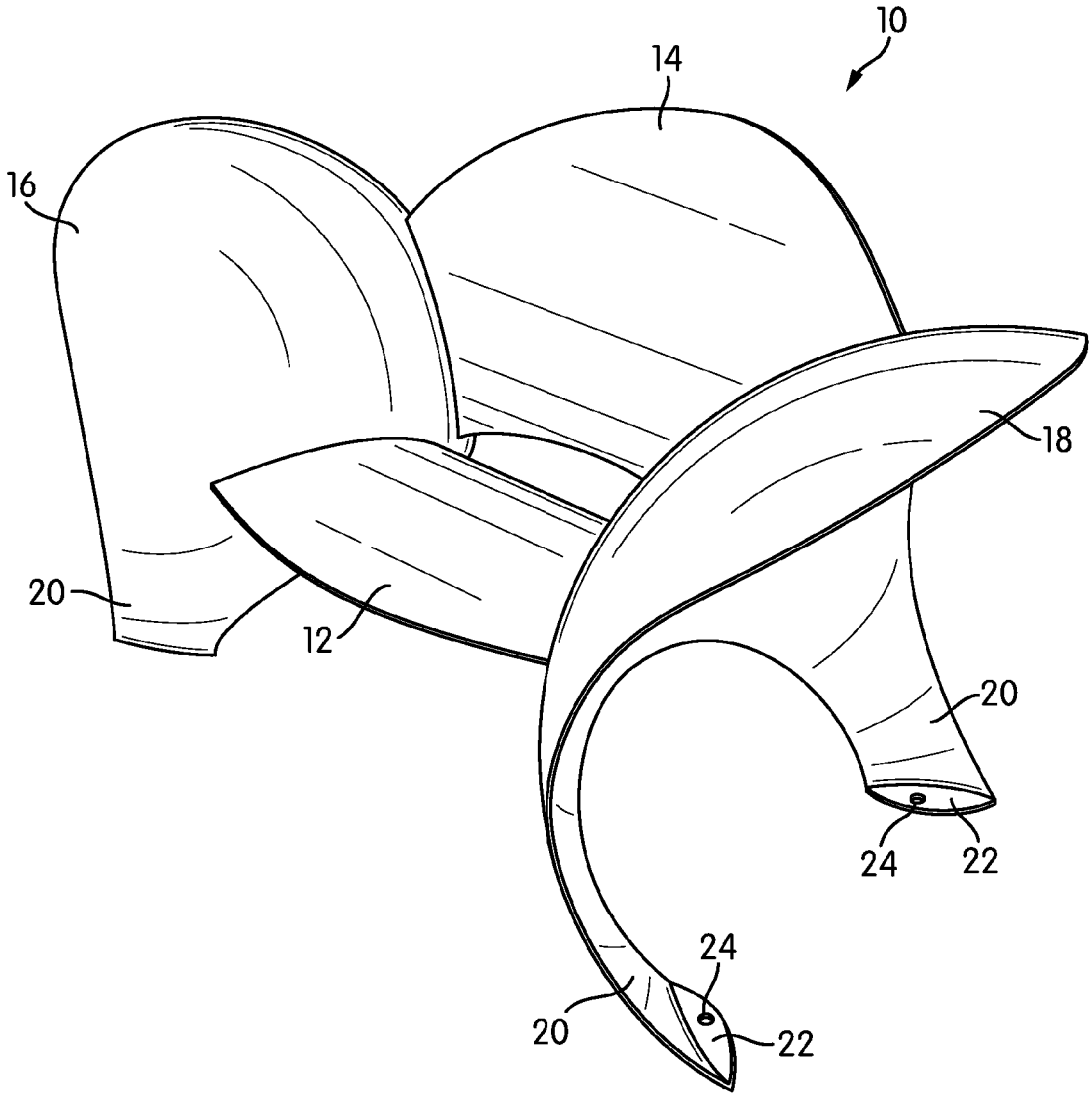
FIG. 1 is a front perspective view of a chair according to one embodiment of the invention.
Figure 2:
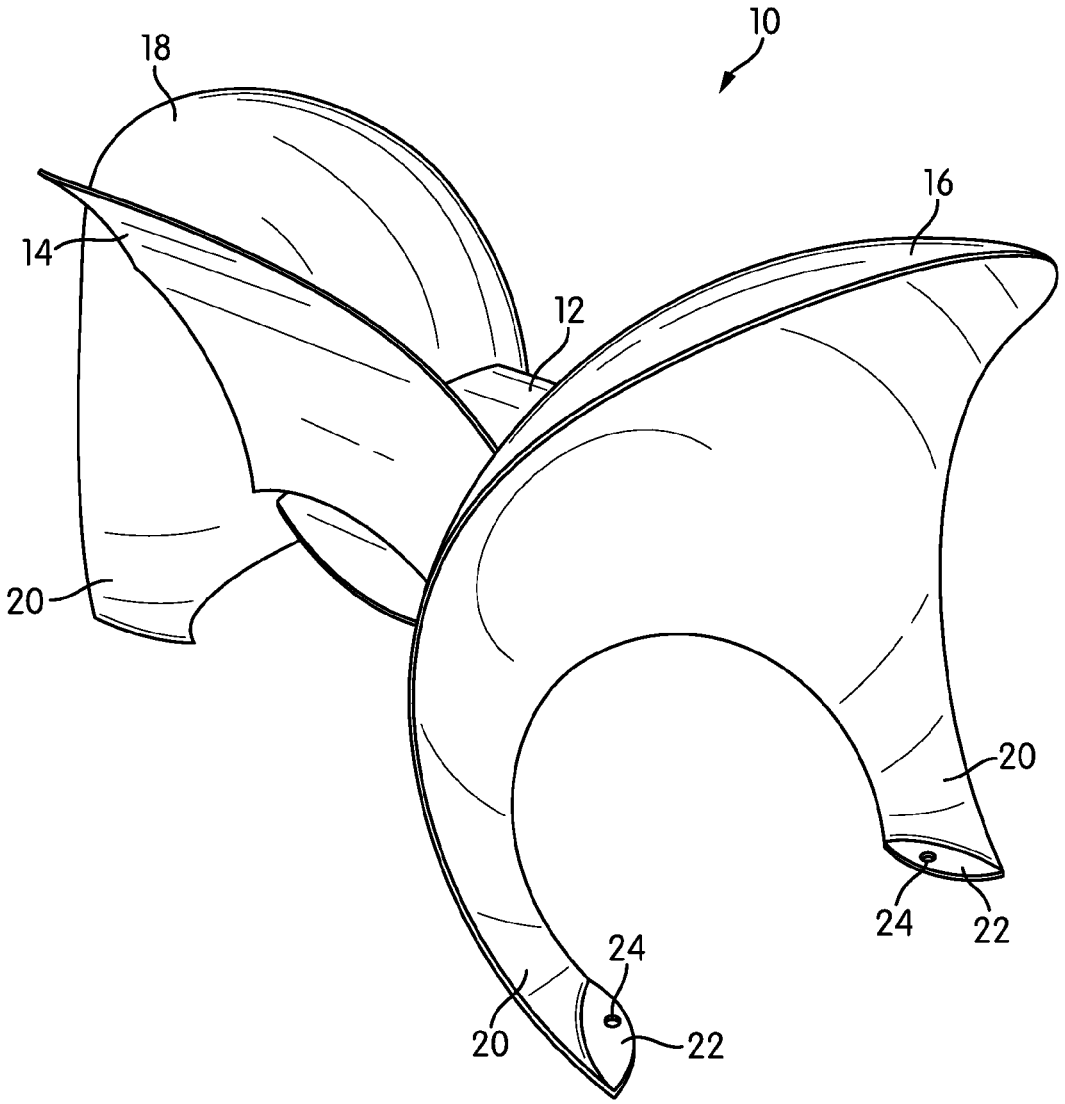
FIG. 2 is a rear perspective view of the chair of FIG. 1.
Figure 3:
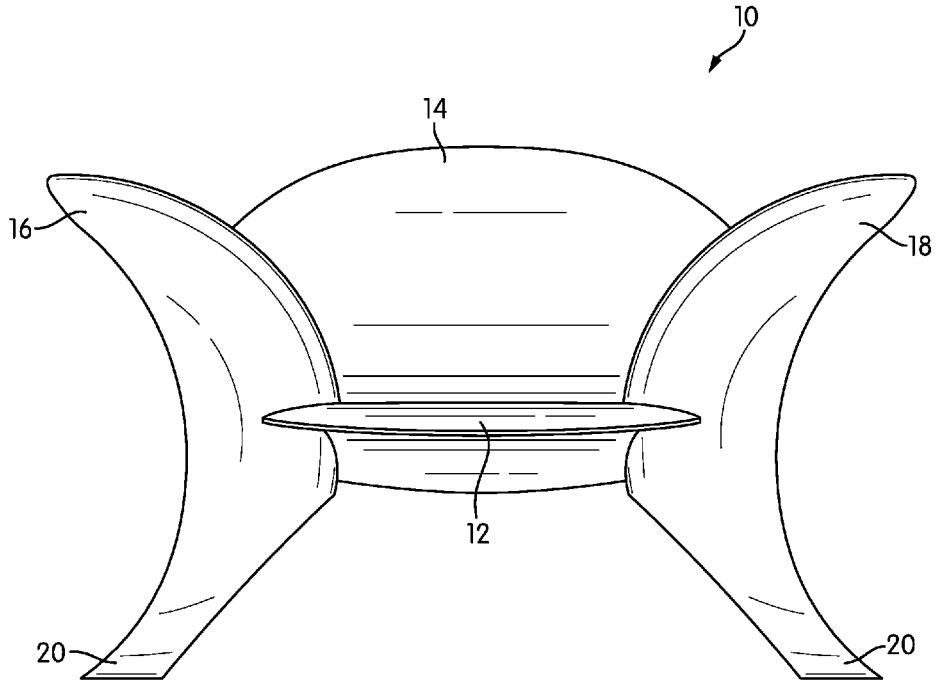
FIG. 3 is a front elevational view of the chair of FIG. 1.

One example of seating according to embodiments of the invention is shown in FIGS. 1-3, which are, respectively, front and back perspective views and a front elevational view of a seat, generally indicated at 10. The seat 10 has a seat portion 12 and a backrest portion 14 that are suspended between two ends 16, 18. The seat portion 12 and backrest portion 14 are both continuously curved, they have the constant radii of curvature of the respective sections of the pressure vessel from which they were cut, and both have a convex curvature relative to a person seated in the seat 10 (i.e., the seat and back portions 12, 14 curve outwardly, toward the person).

In the seat 10 of FIG. 1, the two ends 16, 18 are continuous, cut-hemispherical sections that are welded to respective left and right ends of the seat portion 12 and the backrest portion 14. The two ends 16, 18 are cut to form legs 20. In the illustrated embodiment, each leg 20 includes a foot portion 22 that comes horizontal at ground level and includes a bolt hole 24 that can admit a bolt to secure the seat 10 to the surface on which it rests.

Figure 4:
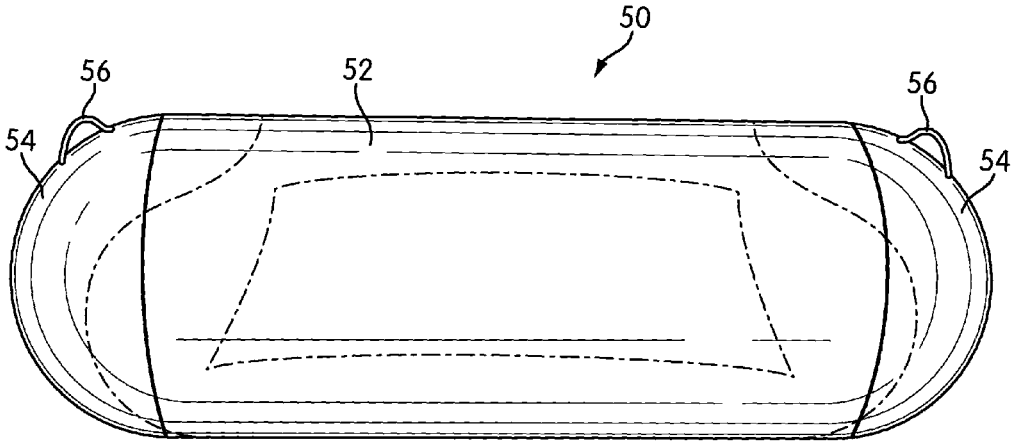
FIG. 4 is a perspective view of an industrial fuel tank, illustrating the general locations from which the parts of the chair of FIGS. 1-3 would be cut.

As was described briefly above, chairs 10 and other pieces of seating according to embodiments of the invention are made using existing, discarded source materials, typically discarded pressure vessels, such as propane tanks FIG. 4 is an illustration of the general shape of a pressure vessel 50 that may be used as source material in methods according to embodiments of the invention. Pressure vessels 50 of this type are typically made of plate steel, with a thickness that varies with the size and capacity of the pressure vessel 50. They typically have the shape shown in FIG. 4, with a generally cylindrical central section 52 and two hemispherical end sections 54. The ends of the central section 52 are typically welded to the end sections 54, and in some cases, the central section 52 may itself be rolled from thick sheet steel and welded into its cylindrical shape. Tanks 50 of this sort may also have any number of handles or fittings 56.

FIG. 4 illustrates with broken lines the general locations from which the pieces of the seat 10 are cut. As shown in FIG. 4, the back and seat portions 12, 14 of the seat 10 are cut from the cylindrical central section 52, while the two ends 16, 18 of the seat 10 are cut from the hemispherical end sections 54 of the pressure vessel 50. Of course, FIG. 4 illustrates only one example of how parts may be cut from a vessel like pressure vessel 50; other examples will be described below.

The thickness of the metal used in the pressure vessel 50 and its dimensions depend on its capacity and on other features. As was described briefly above, the present inventor initially found that discarded propane tanks with capacities of 500-525 U.S. gallons and diameters on the order of about 37 inches were suitable as a starting material. These tanks typically have thicknesses on the order of about 5/16 of an inch. However, the present inventor has more recently found that decommissioned propane tanks with capacities in the range of 250-300 U.S. gallons and diameters on the order of about 30 inches are particularly suitable for embodiments of the invention, because they have wall thicknesses on the order of about ¼ of an inch, making the final product significantly lighter without compromising strength or durability.

Because most pressure vessels are made of plate steel (or other metal) that is much thicker and stronger than is necessary for seating applications, the thickness of the metal of the pressure vessel 50 is generally not critical, except to the extent that it affects the final weight of the piece. In general, pressure vessels of any thickness may be used so long as the walls of the vessel have sufficient strength to support one or more people sitting on the furniture, with thinner-walled vessels being preferred in most cases because of their lighter weight.

Figure 5:
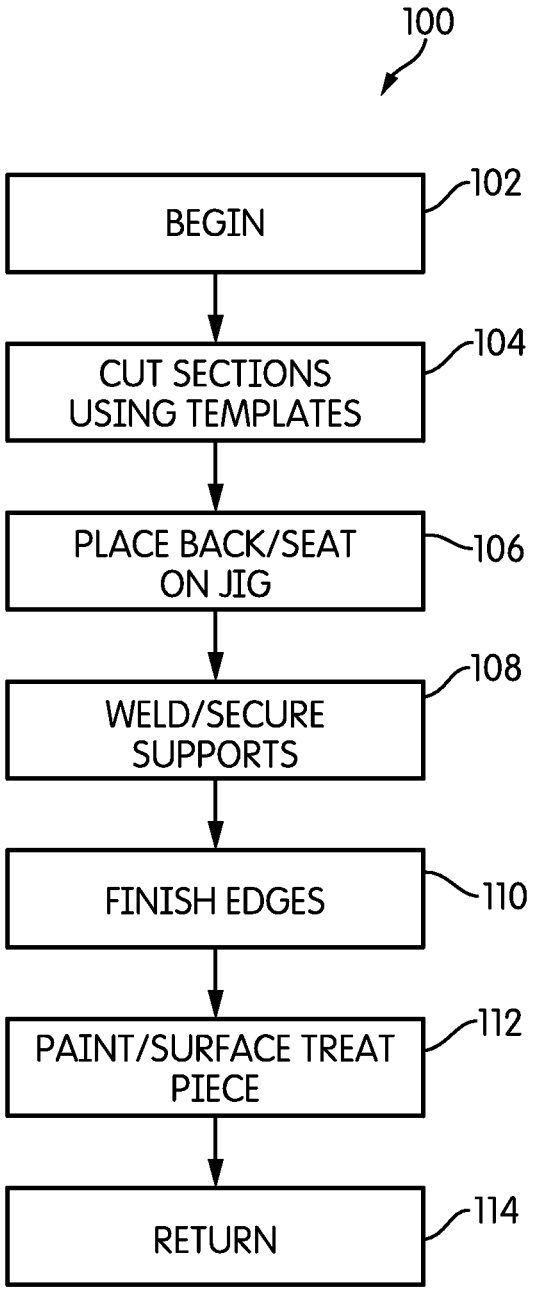
FIG. 5 is a flow diagram of a method of making pieces of seating according to other embodiments of the invention.

FIG. 5 is a high-level flow diagram of a method, generally indicated at 100, for making piece of furniture like the seat 10 of FIGS. 1-3. Method 100 begins at 102 and continues with task 104. In task 104, appropriate sections of the source material, like pressure vessel 50, are cut. If the sections are being cut by hand, template pieces may be clamped or otherwise temporarily secured against the surface of the tank to act as guides for the cutting. Cutting may be done using a plasma torch or any other cutting device capable of cutting the plate steel of the pressure vessel 50 cleanly and efficiently. The template pieces may be slightly smaller than the finished piece to allow an offset for the head of the cutting tool.

In some embodiments, automated processes and machine tools may be used for cutting. For example, a 5-axis computer numerically controlled (CNC) cutting machine may be used. With a CNC machine tool, a computer program controls the path and actions of the tool and serves the same purpose as a template in hand-cutting processes. Thus, the term "template" should be construed to include computer programs that control the cutting path of a CNC machine tool, as well as physical devices or guides that define or limit the path of a manually-applied tool.

As was described above, pressure vessels may have any number of fittings, handles, or other parts. At least some of these parts, like fittings and handles, may be retained and incorporated in seating so long as parts can be cut in a way that keep those fittings in out-of-the-way locations. For example, fittings or openings may be included toward the top of a backrest portion 14 or on the end portions 16, 18 without interfering with the function of the piece of furniture 10.

Once the constituent pieces are cut, method 100 continues with task 106, in which the seat portion 12 and the backrest portion 14 (if any) are placed on a jig for assembly. As was described briefly above, early creations from the present inventor were made by ad hoc processes that did not include the use of templates or a jig. However, a jig ensures that the most ergonomically important portions 12, 14 of the piece are in the correct position overall and the correct position with respect to one another to create a comfortable piece of seating.

Figure 6:
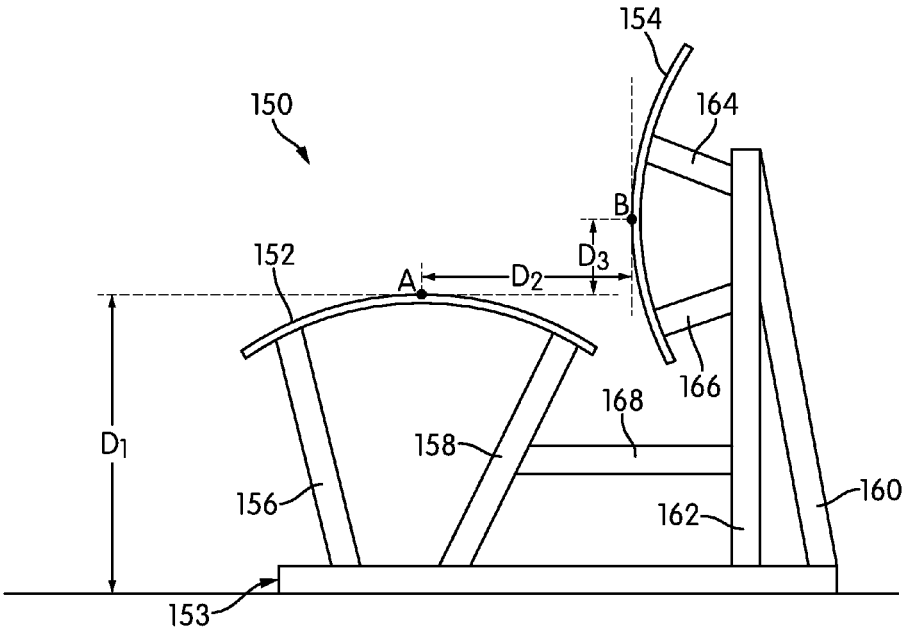
FIG. 6 is a side elevational view of a jig used in the method of FIG. 5.
Figure 7:
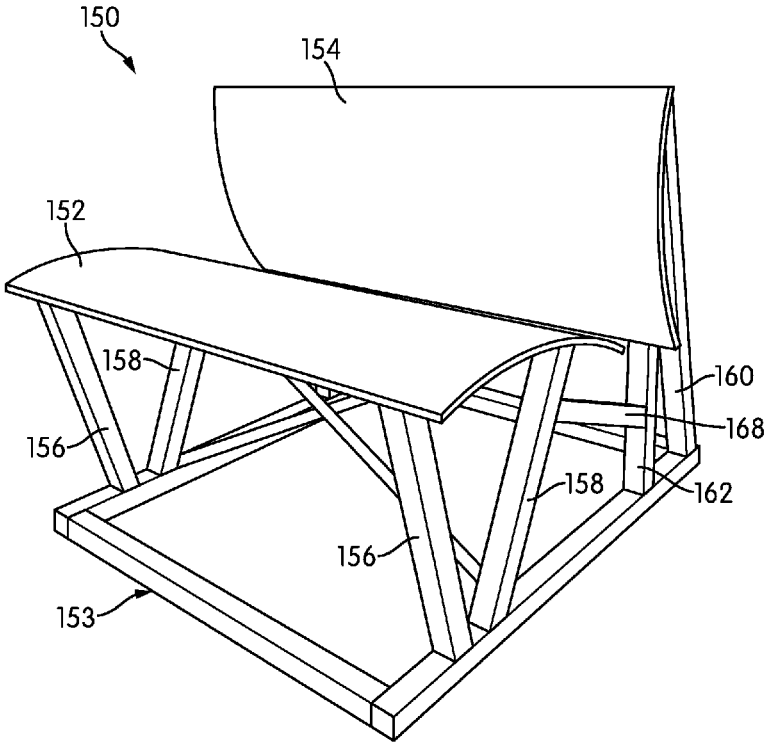
FIG. 7 is a perspective view of the jig of FIG. 6.

FIG. 6 is a side elevational view of a jig 150 that may be used in methods like method 100, and FIG. 7 is a perspective view of the jig 150. The jig 150 includes a convexly-curved seat position member 152 and a convexly-curved backrest position member 154 that are spaced from and positioned generally perpendicular to one another by a number of support members. The seat and backrest position members 152, 154 have the same curvature as the curvature of the central section 52 of a pressure vessel 50, they are continuously curved and, because the central section 52 of the pressure vessel 50 has a constant radius of curvature, the two position members 152, 154 have constant radii of curvature in the forward-rearward plane shown in the side elevational view of FIG. 6.

The seat position member 152 is placed so that the highest point of its curve, indicated at point A, lies at a specified distance above ground level, shown in FIG. 6 as $D_1$. In the illustrated embodiment, and in most jigs 150 designed for people of average height, $D_1$ will be about 17 inches above ground level. The actual height of the seat position member 152 may be slightly lower than 17 inches to allow for the thickness of the seat portion 12 that will be placed on top of it.

In the forward-rearward plane, seat position member 152 is arranged to support a seat portion 12 approximately 20-21 inches deep. Point A, highest point of the curve of the seat position member 152, is placed at a distance $D_2$ forward of the outwardmost (i.e., highest) point of the backrest position member 154, indicated as point B. In most jigs 150 designed for people of average proportions, $D_2$ will be on the order of about 12-13 inches. The backrest position member 154 is itself positioned such that its outwardmost point, point B, is at a defined vertical distance, indicated as $D_3$ in FIG. 6, above the highest point of the seat position member 152. In most jigs 150 designed for people of average proportions, $D_3$ will be on the order of about 4-5 inches. Of course, other jigs 150 may be designed to make furniture with smaller or larger proportions for children or adults with unusual proportions.

As can be seen in FIGS. 6 and 7, the jig 150 has a horizontal rectangular frame 153 that rests on a horizontal surface to support it. Two members 156, 158 of hollow, rectangular cross section arise vertically on each side of the frame 153 to support the seat position member 152. Two sets of vertical members 160, 162 are attached to the rear corners of the frame 153 and extend upwardly toward each other, such that the two members 160, 162 form a triangle with the frame 153. The two sets of vertical members 160, 162 support sets of outwardly-extending members 164, 166 (visible in the view of FIG. 6) that attach to and support the backrest position member 154 in its position generally perpendicular to the seat position member 156. An additional horizontal member or members 168 may connect the members 158 that support the seat position member 152 with the members 162 that support the backrest position member 154. Although FIGS. 6 and 7 illustrate the particular support structure of the jig 150, it should be understood that the method of construction of the jig 150 and the arrangement of its support members are not critical so long as the jig 150 is capable of supporting seat and backrest portions in the correct positions.

Essentially, the jig 150 establishes a spatial relationship between the parts that are placed on it, so that the resulting seating has a seat portion and, if present, a backrest portion of the appropriate size and proportions. The inventor has discovered that seating with a variety of functional and aesthetic configurations can be created from parts of different shapes if the parts have the spatial relationship that is created by the jig 150.

In other words, the width of the parts used to create the seat and backrest portions of seating is not critical and may be varied as long as the parts can be supported by the jig 150—longer and shorter parts may be used to create, for example, a chair for a single person or a bench for several people. Similarly, the shape of the seat and backrest parts, and the shape of the supporting parts that are attached to them, are also not critical and may be varied. Thus, as those of skill in the art will recognize, the jig 150 of FIGS. 6 and 7 creates a way to use continuously curved pieces of material to create ergonomically comfortable seating; the jig 150 does not constrain or define the overall shape of the resulting piece of seating. Thus, the jig 150 is useful in creating a wide variety of finished seating pieces. However, in some embodiments, jigs may impose other constraints to define, for example, the overall length or shape of a piece.

With the relationship set forth above, the present inventor has found that people of heights from about 4 foot, 11 inches (150 cm) to about 6 foot, 5 inches (196 cm) find the resulting seating comfortable. For many people, the curvature of the backrest may coincide with the lumbar curvature, and for some people, Point B may coincide with the deepest point of the lumbar curvature.

With respect to method 100 of FIG. 5, once the seat and back portions 12, 14 are clamped on the jig 150 in the proper positions, method 100 continues with task 108, where the clamped parts 12, 14 are welded to appropriate supports. For example, if the seat 10 is being constructed, the seat and back portions 12, 14 would be welded to the two ends 16, 18. Any appropriate welding techniques or processes may be used.

In some embodiments, instead of welding one piece to another, appropriate brackets may be welded to the seat and backrest portions and the ends. These brackets would have holes for bolts, and would allow the piece of furniture to be shipped in parts and assembled by hand at the installation location, thus saving on shipping costs.

Once the piece of furniture is welded, as shown in method 100, a number of finishing steps may be undertaken. First, as shown in task 110, the edges of the pieces may be ground, sanded, or otherwise smoothed. Any rust, scale, or other surface anomalies on the parts may also be ground or sanded off. Although task 110 is shown as occurring after welding, the parts may be individually edge-ground and surface finished prior to assembly. In that case, additional edge finishing may occur after welding to address any issues introduced by the welding process.

Finally, in task 112, the finished piece (or its completed, disassembled parts) are painted or otherwise surface treated to finish them. The piece may be painted with a single coat of paint, it may be painted using multiple layers of primer, undercoat, and topcoat, or it may be painted with a single layer of paint. Other surface finishing techniques, including powder coating, may also be used.

In general, pieces of furniture according to embodiments of the invention may be used indoors or outdoors, although their construction makes them particularly suitable for use outdoors. If intended for outdoor use, any conventional surface treatment processes, including galvanization, may be used to reduce the possibility of rusting or other deleterious effects due to environmental exposure.

Method 100 completes and returns at task 114.

The general set of tasks of method 100 may be applied to pieces of furniture of different types. The seat 10 illustrated in FIGS. 1-3 and the pieces of furniture disclosed in the three Selig design patents incorporated by reference above are of one type of furniture: a seat and back supported between two ends. As these four examples demonstrate, the length, symmetry, and aesthetic look of these pieces can differ significantly.

Other types of furniture that may be made by these methods include backless benches, in which there is no back and a seat is suspended between or among two or more ends; armless seats, in which a continuous, generally C-shaped section of material forms the backrest and rear legs of the piece, and other curved sections are provided to secure the back to the seat and to support the front of the seat; and designs that use a "floating" seat and backrest, where the back and seat portions are smaller sections of tank that are supported by curved sections welded between them.

While the invention has been described with respect to certain embodiments, the description is intended to be exemplary, rather than limiting. Modifications and changes may be made within the scope of the invention, which is defined by the claims.

What is claimed is:

1. A method of making seating, comprising:

cutting a preformed pressure vessel into seating parts using one or more templates to define the shape of the parts, the seating parts being of continuous curvature with defined radii of curvature derived from the pressure vessels;

temporarily securing at least some of the seating parts to a jig, the jig including a curved seat position member and a curved backrest position member arranged generally perpendicular to one another, the seat position member being arranged such that (1) a highest point of the seat position member lies at about 17 inches from a ground level, and (2) an overall depth of a seat of the seating is about 20-21 inches with at least about 12-13 inches extending rearwardly of the highest point of the seat position member when the seat is placed on the seat position member such that a highest point of the seat curvature coincides with the highest point of the seat position member; and with the seating parts secured to the jig, securing the seating parts together into the seating.

2. The method of claim 1, further comprising grinding edges of the seating parts.

3. The method of claim 1, further comprising coating surfaces of the seating parts.

4. The method of claim 1, wherein the preformed pressure vessel has a generally cylindrical central section with hemispherical endcaps.

5. The method of claim 4, wherein the preformed pressure vessel comprises a propane tank.

6. The method of claim 5, wherein the propane tank has a capacity of about 250-300 U.S. gallons and a diameter of about 30 inches.

7. The method of claim 5, wherein the propane tank has a wall thickness on the order of about 0.25 inches.

8. The method of claim 1, wherein the backrest position member is arranged such that an outwardmost point of the backrest position member is positioned about 4-5 inches above the highest point of the seat position member.

9. The method of claim 1, wherein said securing comprises welding the seating parts together.

10. The method of claim 1, wherein said securing comprises bolting the seating parts together.

11. A method of making seating, comprising:

cutting a preformed pressure vessel having a cylindrical center section and hemispherical end sections into a curved seat portion and curved first and second supports, the seat portion having a line of maximum curvature;

securing the cut seat portion onto a corresponding curved seat position member of a jig, the curved seat position member having a line of maximum curvature arranged about 17 inches from a ground level, such that the line of maximum curvature of the seat portion aligns with the line of maximum curvature of the seat position member, and such that an overall depth of the seat portion is about 20-21 inches with at least about 12-13 inches extending rearwardly of the line of maximum curvature of the seat position member;

with the seat portion attached to the jig, attaching the first and second supports to the seat portion to assemble the seating; and releasing the seating from the jig.

12. The method of claim 11, further comprising grinding edges of the seating.

13. The method of claim 11, further comprising coating surfaces of the seating.

14. The method of claim 11, wherein the preformed pressure vessel comprises a propane tank.

15. The method of claim 11, wherein said cutting further comprises using one or more templates to cut the preformed pressure vessel.

* * * * *